United States Patent [19]

Berchem et al.

[11] Patent Number: 4,744,158

[45] Date of Patent: May 17, 1988

[54] EXCAVATOR TOOTH ASSEMBLY FOR EARTH MOVING EQUIPMENT

[75] Inventors: Rütger Berchem, Gelsenkirchen; Georg Prokscha, Recklinghausen, both of Fed. Rep. of Germany

[73] Assignee: Berchem & Schaberg GmbH, Gelsenkirchen, Fed. Rep. of Germany

[21] Appl. No.: 924,618

[22] Filed: Oct. 29, 1986

[30] Foreign Application Priority Data

Oct. 29, 1985 [DE] Fed. Rep. of Germany ..... 3538354

[51] Int. Cl.[4] ..... E02F 9/28

[52] U.S. Cl. ..... 37/142 R

[58] Field of Search ..... 37/142 R, 141 T, 142 A; 299/91, 92, 93

[56] References Cited

U.S. PATENT DOCUMENTS

| | | | |
|---|---|---|---|
| 817,512 | 12/1905 | Palmer | 37/142 R |
| 2,159,104 | 5/1939 | Ratkowski | 37/142 R |
| 3,342,532 | 9/1967 | Krekeler | 37/142 A |
| 3,397,012 | 8/1968 | Krekeler | 299/92 |
| 3,498,677 | 3/1970 | Morrow | 37/142 R |
| 3,619,009 | 11/1971 | O'Leary | 299/91 |
| 4,212,559 | 7/1980 | Persson | 37/142 A |
| 4,233,761 | 11/1980 | Ryerson | 37/142 R |

FOREIGN PATENT DOCUMENTS

| | | | |
|---|---|---|---|
| 2534910 | 2/1976 | Fed. Rep. of Germany | 37/142 R |
| 7711824 | 5/1979 | Netherlands | 37/142 A |

*Primary Examiner*—Edgar S. Burr
*Assistant Examiner*—James A. Lisehora
*Attorney, Agent, or Firm*—Karl F. Ross; Herbert Dubno

[57] ABSTRACT

The digging tool assembly for an excavator in which the tooth tip is formed with a pin anchored by a securing ring in a recess of an adapter head which fits into the tooth base and traverses a hole in the tooth base so that the pin not only holds the tooth tip and the tooth base together but also anchors both of them to the adapter head which mounts the tool on the movable tool carrier of the excavator, e.g. a tunneling machine or a suction dredge.

1 Claim, 1 Drawing Sheet

EXCAVATOR TOOTH ASSEMBLY FOR EARTH MOVING EQUIPMENT

CROSS REFERENCE TO RELATED APPLICATION

This application is related to our commonly assigned copending application Ser. No. 924,617 filed 29 Oct. 1986 and has reference as well to the following commonly owned applications:

| | |
|---|---|
| Ser. No. 701,580 | filed 14 February 1985; |
| Ser. No. 821,997 | filed 24 January 1986; |
| Ser. No. 901,269 | filed 27 August 1986. |

FIELD OF THE INVENTION

Our present invention relates to a digging tool assembly for an excavator, and more particularly, to a tooth arrangement for earth moving machinery such as tunneling machines, dredges, including suction-head dredges, drag-bucket excavators and like excavating machines in which the digging tool is a tooth mounted upon a movable member of the machine.

More particularly, this invention relates to a tooth assembly for such excavators of the type wherein an adapter can be fixed to the moving element and has a tooth separate from the adapter but mounted thereon and composed of a tip portion forming predominantly the working element of the tooth, and a tooth base by which the tooth element is mounted on the adapter. In such systems, moreover, a support crown of the tooth tip is braced against a complementary support surface of the tooth base.

BACKGROUND OF THE INVENTION

As will be apparent from the aforementioned copending application Ser. No. 924,617 filed 29 Oct. 1986, German Utility Model application No. G 85 08 332.1 and related art, one of the advantages of a digging tooth consisting of a tooth tip separate from a tooth base is that these two elements can consist of different materials. For example, the tooth tip can consist of a highly wear-resistant material while the tooth base, which is subjected to less wear, can be composed of a more ductile or resilient material more capable of withstanding high bending stresses. As a result, the overall life of a tooth can be increased.

In the arrangement of the above-mentioned German Utility Model, the tooth base is provided with a finishing pin which is received in a recess of the tooth tip and is anchored by bending or wedging therein. The wedge or pin connection is provided in a wear region of the tooth tip.

The connecting system is subjected to abrasive and impact stress by the detritus or material to be excavated giving rise rapidly to reduction in thickness of the material of the tooth tip in the region of the wedge or pin connector. In practice, therefore, such earlier arrangements, while satisfactory for considerable time, can result in premature deterioration of the connection and separation of the tip of the tooth from the base.

OBJECTS OF THE INVENTION

It is, therefore, the principal object of the present invention to provide a more secure connection of the tooth tip and tooth base in a digging tool assembly for the purposes described.

Another object of this invention is to provide an improved digging tool assembly in which the connection between the tooth tip and tooth base is less susceptible to wear, impact and like abrasive actions in use than earlier tooth assemblies.

A further object of this invention is to advance the principles of the earlier applications mentioned above.

SUMMARY OF THE INVENTION

These objects and others which will become apparent hereinafter are attained in accordance with the present invention by providing the tooth tip, preferably integrally, with a fastening pin which projects from an end opposite the working end of the tooth tip and is surrounded by a supporting shoulder or crown which braces against a complementary shoulder of the tooth base surrounding a hole in the latter aligned with a recess in the adapter into which the pin extends and in which the pin is held by a securing means.

In accordance with the invention, therefore, the tooth tip is not directly retained on the tooth base but rather has a releasable connection directly with the adapter head and the securing pin of the tooth tip can have any desired cross sectional area, e.g. can be of rectangular or other quadrilateral cross section of even circular cross section.

When, however, the pin is of circular cross section, the supporting shoulders of the tooth base and the tooth tip can be provided with mutually engaging complementary antirotation elements preventing the tip from rotating about an axis of the pin relative to the base.

According to a feature of the invention, while the pin is received with play in the recess of the adapter, it is close-fittingly or snugly received in the hole in the tooth base. In this case, the forces applied to the tool tip or to the tool base work together on both and allow the force transfer between the tooth consisting of the tooth base and the tooth tip to the adapter to be taken up by the frustoconical plug and socket joint formed thereby. The point at which the pin is anchored in the recess of the adapter head therefore is thus largely relieved of this force transfer. Detrimental bending stresses upon the pin are thereby avoided.

The fastening pin can be anchored in the recess of the adapter head in various ways but preferably a plug connection is desired. This plug connection can include a frustoconical end of the pin which form-fittingly engages in a conical portion of the recess.

The securing means can include an indexing groove formed in the pin, an indexing groove formed in a wall of the recess and adapted to be aligned with the groove in the pin, and a prestressed elastically deformable fastening pin partly received in each of these grooves.

The fastening pin can be composed of a synthetic resin (plastic) or rubber and preferably has a circular cross section.

Assembly of the device can be facilitated and simplified when the fastening pin has a conical configuration since this configuration allows it to spread the elastically deformable fastening ring as the pin is inserted into the adapter head recess, thereby permitting the pin to spring back into the groove of the pin.

It has been found to be advantageous, in addition, to provide a pressing surface which may be frustoconical and can converge in a direction of convergence opposite that of the ring-spreading portion of the pin and which can form a flank of the indexing groove of the latter, this pressing surface engaging the fastening ring at an acute angle to the wall of the recess so as to brace the ring against the tooth base. The force with which the tooth tip is pressed against the base at the aforementioned shoulders is determined by the prestress supplied by the elastic ring and the angle of the pressing surface. Hence the pressing surface should extend beyond the fastening ring, thereby also allowing an axial length compensation and ensuring that the two support shoulders will abut one another.

Obviously this arrangement ensures that there will be an increasing force urging these shoulders together as the tendency toward withdrawal of the base from the adapter increases, e.g. with centrifugal force as may be generated during operation of the excavator. The plug connection between the pin and the adapter thus serves not only to fasten the tip with respect to the tooth base, but also for retaining the tooth base on the adapter even though it is also advantageous to provide a corresponding securing means between the adapter and the tooth base directly. This latter securing means can include recesses in the adapter head and the tooth base and a respective ring.

Among the advantages of this construction are that the action between the tooth tip and the tooth base is releasable without special tools, although the connection is such that it is not subject to wear, abrasive action and similar stresses. The assembly has high reliability and long useful life. The supporting shoulders or crowns of the tooth tip and the pins can be standardized for a variety of configurations of the tooth tip, e.g. chisel or point shape so that the actual tip geometry can be selected to suit the particular task.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
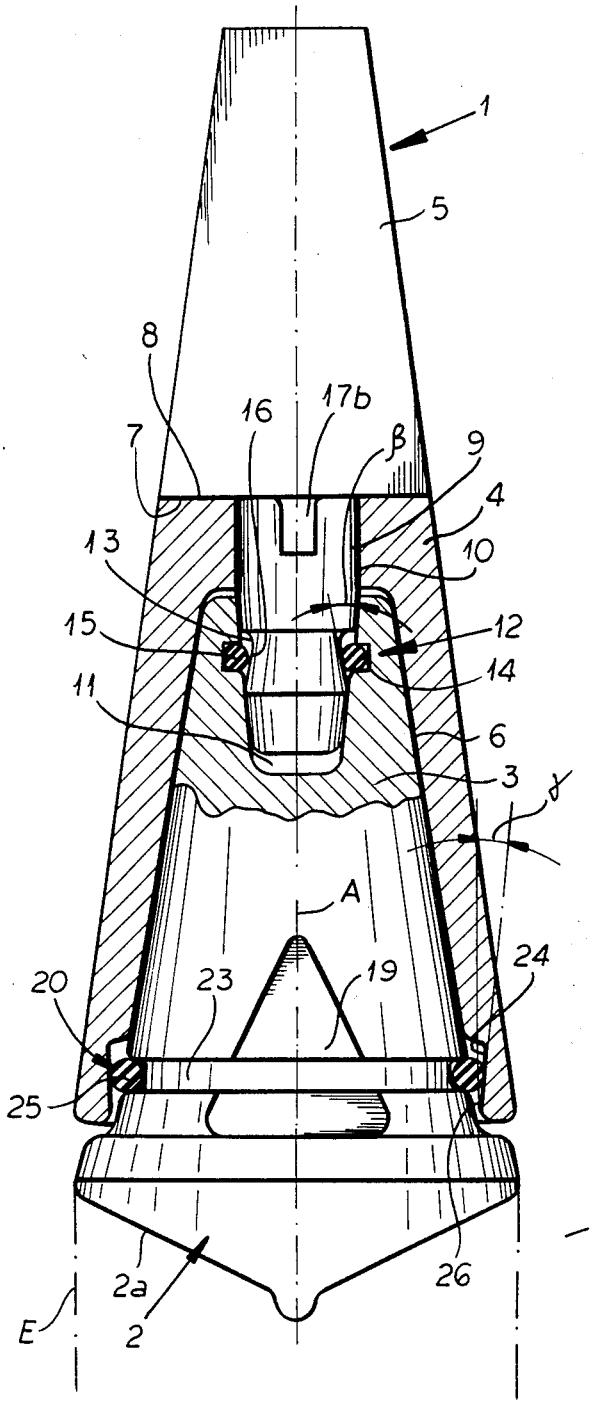
FIG. 1 is a front view of the assembly of the invention, partly broken away.
Figure 2:
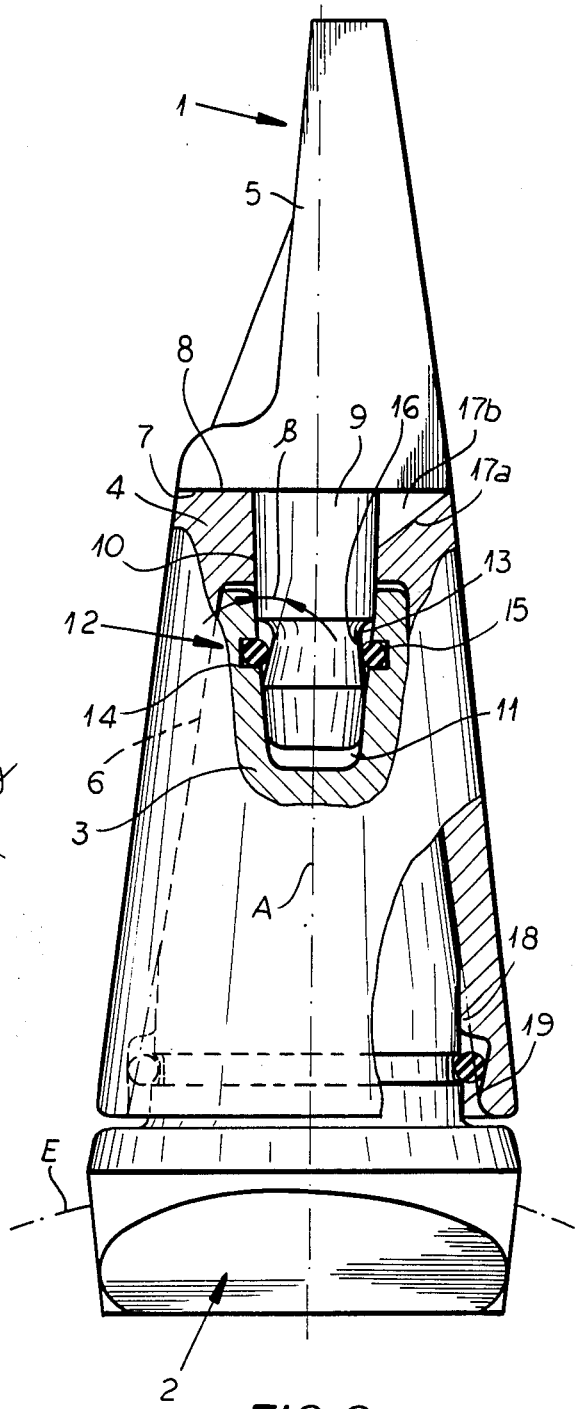
FIG. 2 is a side view thereof, likewise broken away.

In the drawing we have shown a digging tool assembly or tooth assembly for an excavator, e.g. a tunneling machine or the suction head of a suction-head dredge, such machines generally comprising a rotary member E (FIG. 1) provided with a plurality of such assemblies or teeth adapted to bite into the material to be excavated.

An adapter 2 is generally welded at its base section 2*a* to the tool carrier E and is formed with a frustoconical adapter head which constitutes a plug or male formation engageable in the tooth base 4.

The tooth proper consists of a tooth tip 5 which is replaceable and can have any configuration desired for a particular earth moving operation, and the tooth base 4.

The tooth base 4 is provided with a frustoconical female formation 6 forming a socket snugly engaging the plug formation of the adapter head 3.

At its end turned away from the tool support E, the tooth base 4 is provided with a supporting surface or shoulder 7 engaging a complementary supporting shoulder or crown 8 surrounding a fastening pin which is formed on the tooth tip 5 and projects from an end of the latter opposite the working end.

The fastening pin 9 extends through a hole 10 surrounded by the shoulder 7 in the tooth base 4 into the recess 11 aligned with the hole 10 but formed in the adapter head 3.

A securing means 12 is provided in this recess to retain the pin releasably therein.

In the embodiment illustrated, the pin 9 has a tolerance fit in the hole 10 but can be received with some play in the recess 11 of the head 3.

The securing means 12 includes an indexing groove 13 in the pin 9, an indexing groove 14 in the wall of the recess of the adapter head and an elastically deformable fastening ring 15 bearing under prestress upon the pin radially and received in both of the grooves 13 and 14.

The ring 15 rests upon a frustoconical pressing surface 16 and is braced against the indexing groove 13 so that the elastic force with which the tooth tip 5 is held against the tooth base 4 is determined by the radially inward force generated by the prestress of the elastic ring and the angle $\beta$ formed by the surface 16. The securing means 12, therefore, retains the tooth tip against axial shifting.

Rotation of the tooth tip is prevented by the complementary form-fitting elements 17*a* and 17*b* which form a groove and key structure on the shoulder 7 and the shoulder 8, respectively.

In the illustrated embodiment, the adapter head 3 is externally frustoconical and a further securing means 20, functionally equivalent to the securing means 12, is provided between the bottom end of the tooth base 4 and the bottom end of the adapter head 3. In this case, a groove 23 is provided in the adapter head and is juxtaposed with a groove 24 in the tooth base 4, an elastic ring 25 being received in these grooves and being stressed outwardly to press against a frustoconical surface 26 which is inclined at an angle $\gamma$ to the axial direction by analogy with the angle $\beta$.

The tooth base 4 is formed internally with a triangular projection 18 which engages in a triangular pocket 19 of the adapter head 3 at the bottom thereof, formations 18 and 19 constituting form-fitting keying formations which preferably lie in planes parallel to the axis A and prevent rotation of the tooth base 4 relative to the adapter head.

We claim:

1. A digging tool assembly for an exacavator, comprising:

an adapter adapted to be mounted upon said excavator and formed with an adapter head constituted as a male frustoconical plug formation, said plug formation having a recess opening at an end thereof; and a tooth separate from said adapter but mounted thereon, said tooth comprising:

a tooth base constituted as a socket formation of female frustoconical configuration form-fittingly receiving and completely enveloping said plug formation, a tooth tip separate from but affixed to said tooth base and having a working end, a fastening pin formed on said tooth tip on an end thereof opposite said working end and encircled by a supporting shoulder integrally formed in said tooth tip at said opposite end, a hole formed in said tooth base in alignment with said recess and encircled by a supporting shoulder of said tooth base abutting said supporting shoulder of said tooth tip, said pin extending through said hole into said recess, and received with play in said recess and snugly received in said hole, securing means in said recess engaging said pin for holding said assembly together, said securing means including an indexing groove formed in said pin, an indexing grooved formed in a wall of said recess, and a prestressed elastically deformable fastening ring partly received in each of said grooves and resting upon a frustoconical pressing surface engaging said ring at an acute angle to said wall, mutually engaging complementary anti-rotation elements formed in said shoulders preventing said tip from rotating about an axis of said pin relative to said base, and second securing means including an indexing groove formed in an outer wall of said head, an indexing groove formed in an inner wall of said base, and a prestressed elastically deformable fastening ring partly received in each of said grooves.

* * * * *